US006343819B1

(12) United States Patent
Shiozaki

(10) Patent No.: US 6,343,819 B1
(45) Date of Patent: Feb. 5, 2002

(54) SECURITY TAG

(76) Inventor: Steven Shiozaki, 819 Anita Ave., Belmont, CA (US) 94002-2051

( * ) Notice: Subject to any disclaimer, the term of this patent is extended or adjusted under 35 U.S.C. 154(b) by 0 days.

(21) Appl. No.: 09/513,051

(22) Filed: Feb. 24, 2000

(51) Int. Cl.[7] ..... B65D 27/30
(52) U.S. Cl. ..... 292/307 R; 292/307 A
(58) Field of Search ..... 292/307 R, 307 A, 292/315, 318, 321, 322, 323, 326

(56) References Cited

U.S. PATENT DOCUMENTS

| | | | | |
|---|---|---|---|---|
| 3,712,655 A | | 1/1973 | Fuehrer | |
| 3,717,369 A | * | 2/1973 | Stoffel | 292/321 |
| 4,306,745 A | * | 12/1981 | Wenk | 292/318 |
| 4,441,233 A | | 4/1984 | Swift | |
| 4,470,173 A | | 9/1984 | Adamson | |
| 4,501,049 A | * | 2/1985 | Adamson | 24/30.5 |
| 5,125,700 A | * | 6/1992 | Fattori | 292/318 |
| 5,337,503 A | * | 8/1994 | Goby | 40/665 |
| 5,524,945 A | | 6/1996 | Georgopoulos et al. | |
| 5,765,885 A | | 6/1998 | Netto | |

* cited by examiner

*Primary Examiner*—Gary Estremsky
(74) *Attorney, Agent, or Firm*—Jack Lo

(57) ABSTRACT

The present security tag is comprised of a generally flat body surrounded by a lip for improving grip. A socket is attached to one end of the body, and a card is attached to an opposite end. A strap is attached to a side of the body by a tear band, and offset from the socket. The strap is provided with a narrower waist portion for being easily bent. When a distal end of the strap is inserted into the socket, the offset positioning between the strap and the socket causes the strap to be bent in a way that helps the card to lay flat on an item being secured. A stud at the distal end of the strap is locked in place by radial fingers in the socket. Gussets behind the fingers help them resist being pried back to release the stud. The card includes a first portion and a separable second portion which can be detached from the first portion. Copies of a code are provided on the first and second portions, which can be compared to verify ownership of the item, or if the tag has been surreptitiously replaced. The strap includes a handle portion projecting beyond the tear band that allows the strap to be easily torn from the body for removing the tag after use.

20 Claims, 2 Drawing Sheets

SECURITY TAG

BACKGROUND OF THE INVENTION

1. Field of the Invention

This invention relates generally to security tags.

2. Prior Art

Items, such as luggage, that are subject to handling by strangers or unauthorized persons are vulnerable to tampering or theft. The covers or openings on these items can be sealed with security tags to discourage casual tampering or theft.

A great variety of security tags are known in the prior art. A tag shown in U.S. Pat. No. 5,765,885 to Netto is comprised of an identification card, a strap attached to one end of the card, and a socket attached to another end of the card. The strap is threaded through an item to be locked, e.g., a zipper tab, and inserted into the socket. A separable portion of the card is detached along a perforation and retained by the owner of the item. Copies of a unique serial number are provided on the card and the separable portion. Subsequently comparing the numbers on the card and the separable portion verifies the ownership of the item, or if the original tag has been replaced after tampering. However, the separable portion is small and difficult to detach, and can be easily lost after being detached. The tag can be separated from the item only by cutting, which is very inconvenient when no cutting tool is available.

Another tag shown in U.S. Pat. No. 5,524,945 to Georgopoulos et al is comprised of a card attached to a flat strap. A tear band along the strap allows the tag to be torn up and removed. However, the card lacks a separable portion for being retained by a user as a reference. The number on the tag must be recorded elsewhere. Also, the tear band follows a convoluted path that makes the strap difficult to tear away.

Another tag shown in U.S. Pat. No. 4,470,173 to Adamson is comprised of a card attached to a strap. A socket is connected to the card and strap by a tear band. However, the card lacks a separable portion for being retained by a user as a reference. The convoluted path of the tear band makes the strap difficult to tear away.

Another tag shown in U.S. Pat. No. 4,441,233 to Swift is comprised of a strap attached to a socket. A conical stud attached to the strap is inserted into the socket, and locked in place by radial fingers therein. The strap is removed by breaking the thin ligaments at the base of the stud. However, the radial fingers can be pried back with a sharp point inserted into the socket for surreptitiously detaching the stud without damaging the tag. Further, it has no identification card.

Another tag shown in U.S. Pat. No. 3,712,655 to Fuehrer is comprised of a socket attached to a body. A strap extending from the body is inserted into the socket and locked in place by fingers therein. There is no way for a user to easily remove the tag, and there is no identification card.

Yet another tag shown in European patent application 895213 is comprised of a card attached to a strap along a tear band. The card lacks a separable portion for being retained by a user as a reference.

Each prior art tag has a strap aligned with a socket, so that when the strap is inserted in the socket, the strap is bent in such a way that the card does not lay flat on the item being secured and is thus difficult to read. The card is flat and smooth, so that it is difficult to grip when detaching the separable portion or the strap. The strap is evenly thick along its length and is thus somewhat difficult to bend.

OBJECTIVES OF THE INVENTION

Accordingly, objectives of the present security tag are:

to seal a cover or opening of an item;

to discourage unauthorized opening of the item;

to help verify ownership of the item with a unique identification code on a card;

to provide a separable portion on the card with a copy of the identification code for convenient reference;

to allow the separable portion to be easily detached;

to prevent the separable portion from being lost after it is detached;

to help determine if the original tag has been replaced by allowing a comparison of the codes on the card and the separable portion;

to lay flat on the item for easier viewing;

to provide an area for displaying information;

to be easy to grip without slipping;

to provide a strap which is easy to bend;

to prevent the strap from being removed from its socket; and to be easily torn up and removed from the item.

Further objects of the present invention will become apparent from a consideration of the drawings and ensuing description.

BRIEF SUMMARY OF THE INVENTION

The present security tag is comprised of a generally flat body surrounded by a lip for improving grip. A socket is attached to one end of the body, and a card is attached to an opposite end. A strap is attached to a side of the body by a tear band, and offset from the socket. The strap is provided with a narrower waist portion for being easily bent. When a distal end of the strap is inserted into the socket, the offset positioning between the strap and the socket causes the strap to be bent in a way that helps the card to lay flat on an item being secured. A stud at the distal end of the strap is locked in place by radial fingers in the socket. Gussets behind the fingers help them resist being pried back to release the stud. The card includes a first portion and a separable second portion which can be detached from the first portion. Copies of a code are provided on the first and second portions, which can be compared to verify ownership of the item, or if the tag has been surreptitiously replaced. The strap includes a handle portion projecting beyond the tear band that allows the strap to be easily torn from the body for removing the tag after use.

DRAWING REFERENCE NUMERALS

10. Body

11. Lip

12. Textured Surface
13. Display Area
14. Socket
15. Fingers
16. Bottom Opening
17. Card
18. Fixed First Portion
19. Separable Second Portion
20. Webs
21. End
22. Eyelet
23. Depressed Area
24. Label
25. Code
26. Dashed Line
27. Strap
28. Tear band
29. Stud
30. Stop
31. Narrowed Waist
32. Handle
33. Edge
34. Top Opening
35. Finger Gussets
36. Socket Gussets
37. Ball
38. Lock Washer

DETAILED DESCRIPTION OF THE INVENTION

Figure 1:
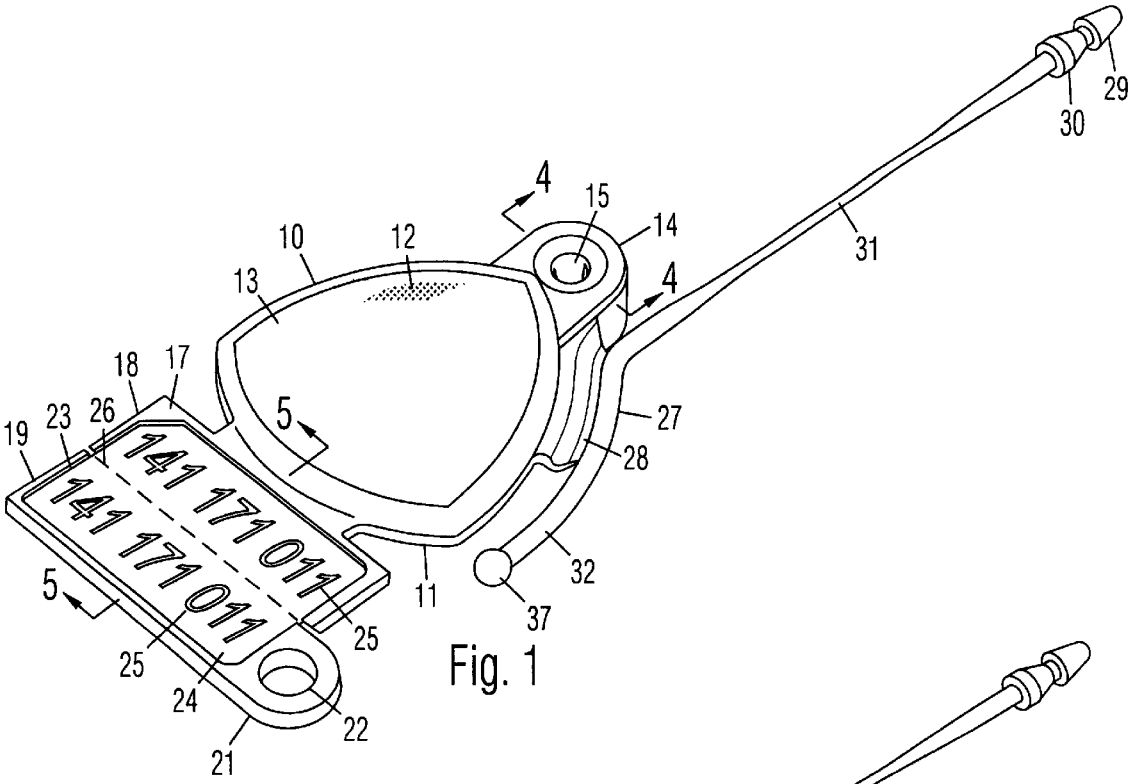
FIG. 1 is a top perspective view of the present security tag.
Figure 2:
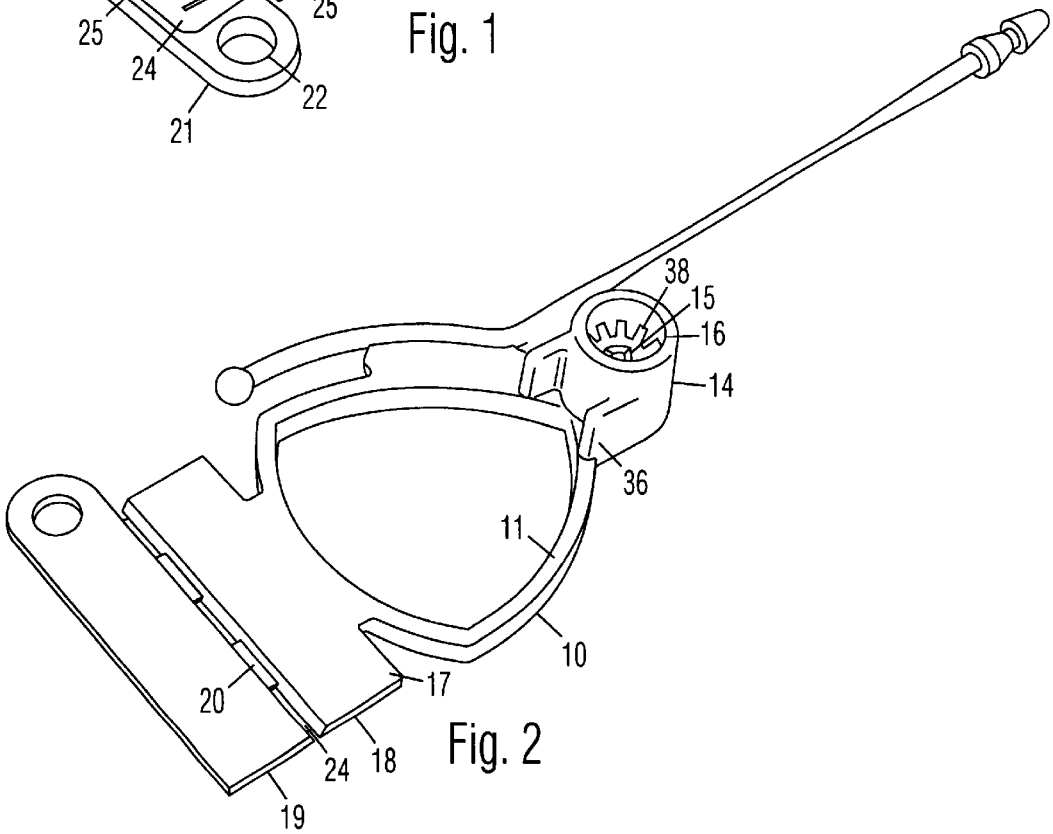
FIG. 2 is a bottom perspective view thereof.

FIGS. 1–2:

A preferred embodiment of the present security tag is shown in a top perspective view in FIG. 1 and a bottom perspective view in FIG. 2. It is comprised of a slightly domed body 10 with a lip 11 along a periphery for improving grip. Body 10 includes a textured surface 12 on an upper side for further improving grip, and a display area 13 on a top side for arranging information, such as a corporate logo. A socket 14 is attached to one end of body 10 and reinforced by socket gussets 36 connected between them. A plurality of radial fingers 15 arranged in socket 14 are substantially recessed within a bottom opening 16 thereof. A lock washer 38 is pressed into socket 14 to protect fingers 15 from tampering.

An identification card 17 is attached to an opposite end of body 10. Card 17 includes a fixed first portion 18 fixed to body 10, and a separable second portion 19 connected to first portion 18 by a plurality of easily breakable webs 20 shown in the bottom view. Second portion 19 has one end 21 projecting beyond a corresponding end of first portion 18 for providing a better grip when separating. An eyelet 22 on second portion 19 is for being attached to a key ring, twist tie, or the like for preventing loss. Eyelet 22 also improves grip when separating second portion 19 from first portion 18.

A front side of card 17 is provided with a depressed area 23 in which a label 24 is applied. Copies of a code 25 are printed on label 24, wherein one is on fixed first portion 18 of card 17, and another one is on separable second portion 19. An exemplar code is shown. Code 25 may have any number of digits. It may include numbers or letters, and is preferably unique for each tag. A dashed line 26 is printed between the copies of code 25 to indicate that second portion 19 of card 17 is detachable. The edges of label 24 are protected from peeling by the rim of depressed area 23. Alternatively, code 25 may be directly applied to card 17 without label 24.

A strap 27 is attached to a side of body 10 by a tear band 28, and offset to a side of socket 14. Tear band 28 includes a thin groove which is easily torn. Strap 27 includes a conical stud 29 at a distal end which can be inserted into socket 14, and an enlarged stop 30 spaced inwardly from stud 29. Stop 30 includes a concial front end for helping resist removal of stud 29 from socket 14. Strap 27 is provided with a narrower waist portion 31 for being easily bent. Strap 27 is also provided with a handle portion 32 at a proximal end which projects beyond tear band 28. Handle 32 is easily gripped for tearing strap 27 from body 10. A ball 37 is attached to an end of handle 32 for further improving grip.

Figure 3:
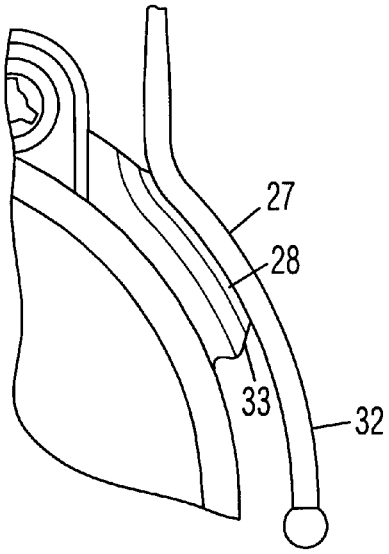
FIG. 3 is a top view of a tear band thereof.

FIG. 3:

A top view of tear band 28 is shown in FIG. 3. It includes an edge 33 which preferably meets handle 32 at an acute angle to provide a stress point where a rip can easily start for detaching strap 27.

Figure 4:
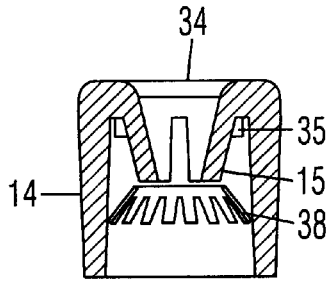
FIG. 4 is a sectional view of a socket thereof, taken along line 4—4 in FIG. 1.

FIG. 4:

Socket 14 is shown in a sectional view in FIG. 4. Radial fingers 15 are positioned around a top opening 34 and angled toward each other. Finger gussets 35 attached behind fingers 15 help them resist being pried back to release the strap. Lock washer 38 shields the back of fingers 15 to positively prevent tampering. Socket 14 is long enough to fully recess the stud when it is inserted to further prevent tampering.

Figure 5:
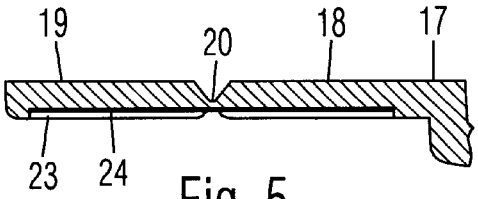
FIG. 5 is a sectional view of an identification card thereof, taken along line 5—5 in FIG. 1.
Figure 6:
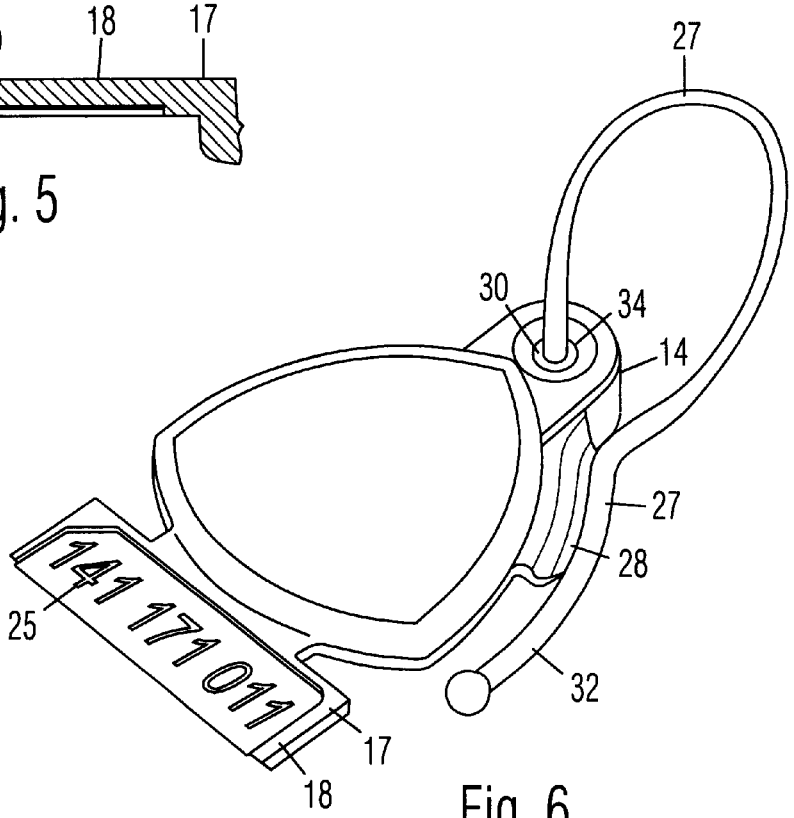
FIG. 6 is a top perspective thereof when a strap is inserted into a socket.

FIG. 5:

A sectional view of card 17 is shown in FIG. 5. Label 24 is positioned in depressed area 23 and protected from peeling. Fixed first portion 18 and separable second portion 19 are connected by thin webs 20 so that second portion 19 can be easily detached.

FIG. 6:

To use, the distal end of strap 27 is inserted into socket 14 until stop 30 is seated against the rim of top opening 34. The offset positioning between strap 27 and socket 14 causes strap 27 to be bent in a way that helps card 17 to lay flat on an item being secured. The second portion of card 17 has been detached and retained by its user for reference. The copy of the code on the second portion is later compared with the copy on first portion 18 for making a positive identification. A match between the copies of the code verifies ownership and that the tag has not been tampered with. A mismatch indicate that the item might belong to someone else, or if the item indeed belongs to the user, the original tag has been certainly removed by an unauthorized person and surreptitiously replaced with another tag.

When no longer needed, the tag is removed by gripping body 10 with one hand, and pulling handle 32 of strap 27 with another hand to rip away strap 27 along tear band 28.

SUMMARY AND SCOPE

Accordingly, the present security tag seals a cover or opening of an item. It discourages unauthorized opening of the item. It helps verify ownership of the item with a unique identification code on a card. It provides a separable portion on the card with a copy of the identification code for convenient reference. It allows the separable portion to be easily detached. It prevents the separable portion from being lost after it is detached. It helps determine if the original tag has been replaced by allowing a comparison of the codes on the card and the separable portion. It lays flat on the item for easier viewing. It provides an area for displaying information. It is easy to grip without slipping. It provides a strap which is easy to bend. It prevents the strap from being removed from its socket. It is also easily torn up and removed from the item.

Although the above description is specific, it should not be considered as a limitation on the scope of the invention, but only as an example of the preferred embodiment. Many variations are possible within the teachings of the invention. For example, . Therefore, the scope of the invention should be determined by the appended claims and their legal equivalents, not by the examples given.

I claim:

1. A security tag, comprising:

a body with a lip along a periphery for improving grip;

a socket attached to said body;

an identification card attached to said body, said card including a fixed first portion fixed to said body, and a separable second portion connected to said first portion by a breakable web, a plurality of copies of a code on said card, a first one of said copies being on said fixed first portion of said card, said second one of said copies being on said separable second portion of said card, when said separable second portion is detached and retained for reference, a match between said copies of said code verifies absence of tampering, and a mismatch between said copies of said code indicate that said security tag has been replaced with another tag; and a strap connected to said body by a tear band, said strap for being tied to an item being secured, an axis of said strap being generally perpendicular and offset to a side of said socket to help said security tag lay flat on said item, when a distal end of said strap is inserted into said socket, said strap is locked into said socket, said strap being removable by being torn from said body along said tear band.

2. The security tag of claim 1, further including a textured surface on said body for further improving grip.

3. The security tag of claim 1, further including an eyelet on said second portion of said card for being attached to a key ring after said second portion is separated to avoid loss, said eyelet also for improving grip when separating said second portion.

4. The security tag of claim 1, further including a socket gusset connected between said socket and said body to reinforce said socket.

5. The security tag of claim 1, further including a plurality of radial fingers arranged around a hole in said socket, and a plurality of finger gussets respectively attached behind said fingers to help said fingers resist being pried back.

6. The security tag of claim 1, further including a plurality of radial fingers arranged around a hole in said socket, and a lock washer positioned within said hole to protect said fingers from tampering.

7. The security tag of claim 1, further including a label applied to said card, said copies of said code being applied to said label for convenient manufacturing.

8. The security tag of claim 1, further including a depressed area on said card, and a label recessed within said depressed area to be protected from peeling, said copies of said code being applied to said label for convenient manufacturing.

9. The security tag of claim 1, further including a narrowed waist portion on said strap for assisting bending, said strap having a smooth continuous surface for comfortable handling.

10. The security tag of claim 1, further including a ball attached to a proximal end of said strap for improving grip.

11. The security tag of claim 1, further including a conical stud at said distal end of said strap, so that when said stud is inserted into said socket past said fingers, said stud is prevented by said fingers from being removed, and further including an enlarged stop spaced inwardly from said stud on said strap, said stop including a conical front end to help prevent said stud from being removed from said socket.

12. A security tag, comprising:

a body with a lip along a periphery for improving grip;

a socket attached to said body;

an identification card attached to said body, said card including a fixed first portion fixed to said body, and a separable second portion connected to said first portion by a breakable web;

an eyelet on said second portion of said card for being attached to a key ring after said second portion is separated, said eyelet also for improving grip when separating said second portion;

a plurality of copies of a code on card, a first one of said copies being on said fixed first portion of said card, said second one of said copies being on said separable second portion of said card, when said separable second portion is detached and retained for reference, a match between said copies of said code verifies absence of tampering, and a mismatch between said copies of said code indicate that said security tag has been replaced with another tag;

a strap connected to said body by a tear band, said strap for being tied to an item being secured, an axis of said strap being generally perpendicular and offset to a side of said socket to help said security tag lay flat on said item, when a distal end of said strap is inserted into said socket, said strap is locked into said socket, said strap being removable by being torn from said body along said tear band;

an edge of said tear band meeting said strap at an acute angle to provide a stress point for starting a rip; and a narrowed waist portion on said strap for assisting bending, said strap having a smooth continuous surface for comfortable handling.

13. The security tag of claim 12, further including a textured surface on said body for further improving grip.

14. The security tag of claim 12, further including a socket gusset connected between said socket and said body to reinforce said socket.

15. The security tag of claim 12, further including a plurality of radial fingers arranged around a hole in said socket, and a plurality of finger gussets respectively attached behind said fingers to help said fingers resist being pried back.

16. The security tag of claim 12, further including a plurality of radial fingers arranged around a hole in said socket, and a lock washer positioned within hole to protect said fingers from tampering.

17. The security tag of claim 12, further including a label applied to said card, said copies of said code being applied to said label for convenient manufacturing.

18. The security tag of claim 12, further including a depressed area on said card, and a label recessed within said depressed area to be protected from peeling, said copies of said code being applied to said label for convenient manufacturing.

19. The security tag of claim 12, further including a ball attached to a proximal end of said strap for improving grip.

20. A security tag, comprising:

a slightly domed body with a lip along a periphery for improving grip;

a textured surface on a surface of said body for further improving grip, a display area on said body for arranging information;

a socket attached to said body;

a socket gusset connected between said socket and said body to reinforce said socket;

a plurality of radial fingers arranged in said socket, said radial fingers fully recessed within said socket to resist tampering;

a plurality of finger gussets respectively attached behind said fingers to help said fingers resist being pried back;

a lock washer positioned within said socket to protect said fingers from tampering;

an identification card attached to said body, said card including a fixed first portion fixed to said body, and a separable second portion connected to said first portion by a breakable web, said second portion including one end projecting laterally beyond a corresponding end of said first portion for providing a better grip when being separated;

an eyelet on said second portion of said card for being attached to a key ring after said second portion is separated, said eyelet also for improving grip when separating said second portion;

a depressed area on one side of said card;

a label applied within said depressed area, said label protected from being peeled by said depressed area;

a plurality of copies of a code on said label, a first one of said copies being on said fixed first portion of said card, said second one of said copies being on said separable second portion of said card, when said separable second portion is detached and retained for reference, a match between said copies of said code verifies absence of tampering, and a mismatch between said copies of said code indicate that said security tag has been replaced with another tag;

a dashed line between said copies of said code to indicate that said second portion of said card is detachable;

a strap connected to said body by a tear band, said strap for being tied to an item being secured, an axis of said strap being generally perpendicular and offset to a side of said socket to help said security tag lay flat on said item, said strap being removable by being torn from said body along said tear band;

an edge of said tear band meeting said strap at an acute angle to provide a stress point for starting a rip;

a narrowed waist portion on said strap for assisting bending, said strap having a smooth continuous surface for comfortable handling;

a handle portion at a proximal end of said strap, said handle portion projecting beyond said tear band for being gripped;

a ball attached to an end of said handle portion for further improving grip;

a conical stud at a distal end of said strap, when said stud is inserted into said socket, said stud is prevented by said fingers from being removed; and an enlarged stop spaced inwardly from said stud on said strap, said stop including a concial front end to help prevent said stud from being removed from said socket.

* * * * *